US011769619B2

(12) United States Patent
Park

(10) Patent No.: US 11,769,619 B2
(45) Date of Patent: Sep. 26, 2023

(54) COIL COMPONENT

(71) Applicant: SAMSUNG ELECTRO-MECHANICS CO., LTD., Suwon-si (KR)

(72) Inventor: Kwang Il Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 365 days.

(21) Appl. No.: 16/919,618

(22) Filed: Jul. 2, 2020

(65) Prior Publication Data

US 2021/0210276 A1 Jul. 8, 2021

(30) Foreign Application Priority Data

Jan. 7, 2020 (KR) ..... 10-2020-0002211

(51) Int. Cl.
*H01F 17/00* (2006.01)
*H01F 27/28* (2006.01)

(52) U.S. Cl.
CPC ..... *H01F 27/2885* (2013.01); *H01F 17/0006* (2013.01)

(58) Field of Classification Search
CPC ..... H01F 27/306; H01F 27/292; H01F 27/29; H01F 27/2828; H01F 27/2823; H01F 27/2804; H01F 2027/2809
See application file for complete search history.

(56) References Cited

U.S. PATENT DOCUMENTS 7,746,210 B2 * 6/2010 Ml ..... H01F 27/29 336/200
11,170,927 B2 * 11/2021 Yoon ..... H01F 27/32
2004/0145442 A1 * 7/2004 Matsutani ..... H01F 21/12 336/200
2014/0009254 A1 1/2014 Ohkubo et al.
(Continued)

FOREIGN PATENT DOCUMENTS

CN 110400672 A * 11/2019 ..... H01F 17/04
JP 2010-062502 * 3/2010
(Continued)

OTHER PUBLICATIONS

Office Action issued in corresponding Korean Patent Application No. 10-2020-0002211 dated Mar. 12, 2021, with English translation.

*Primary Examiner* — Marlon T Fletcher
*Assistant Examiner* — Matthew T Sarles
(74) *Attorney, Agent, or Firm* — MORGAN, LEWIS & BOCKIUS LLP

(57) ABSTRACT

A coil component includes a support substrate, a coil portion disposed on one surface of the support substrate and having one end and the other end connected by a plurality of turns, a body in which the support substrate and the coil portion are embedded, a lead portion extending from one end of the coil portion, and an auxiliary lead portion disposed between one end of the coil portion and the other end of the coil portion, and extending from the coil portion to be spaced apart from the lead portion, on one surface of the support substrate. The lead portion and the auxiliary lead portion are exposed to an external surface of the body to be spaced apart from each other.

18 Claims, 16 Drawing Sheets

(56) References Cited

U.S. PATENT DOCUMENTS

| | | | | |
|---|---|---|---|---|
| 2017/0194089 | A1* | 7/2017 | Jang | H01F 27/29 |
| 2017/0243689 | A1 | 8/2017 | Toon et al. | |
| 2017/0287619 | A1 | 10/2017 | Sim et al. | |
| 2018/0145653 | A1* | 5/2018 | Ishizuka | H01F 27/42 |
| 2019/0362877 | A1* | 11/2019 | Yoon | H01F 17/04 |
| 2020/0279684 | A1* | 9/2020 | Toujo | H01F 27/38 |
| 2020/0279687 | A1* | 9/2020 | Koo | H01F 17/04 |
| 2021/0151241 | A1* | 5/2021 | Toujo | H03H 7/09 |
| 2021/0407728 | A1* | 12/2021 | Toujo | H03H 7/0115 |
| 2022/0231653 | A1* | 7/2022 | Toujo | H01F 17/045 |
| 2023/0071624 | A1* | 3/2023 | Toujo | H02K 11/01 |

FOREIGN PATENT DOCUMENTS

| | | | |
|---|---|---|---|
| KR | 10-2014-0005088 | A | 1/2014 |
| KR | 10-2017-0097852 | A | 8/2017 |
| KR | 10-2017-0112446 | A | 10/2017 |
| KR | 10-2018-0054253 | A | 5/2018 |
| KR | 10-2019-0091421 | A | 8/2019 |
| KR | 10-2120198 | B1 | 6/2020 |

* cited by examiner

COIL COMPONENT

CROSS-REFERENCE TO RELATED APPLICATION(S)

This application claims the benefit under 35 USC 119 (a) of Korean Patent Application No. 10-2020-0002211 filed on Jan. 7, 2020 in the Korean Intellectual Property Office, the entire disclosure of which is incorporated herein by reference for all purposes.

TECHNICAL FIELD

The present disclosure relates to a coil component.

BACKGROUND

Inductors, as coil components, are typical passive electronic components used in electronic devices, in addition to resistors and capacitors.

Recently, according to the trend for miniaturization of electronic components, there has been increasing demand for square coil components having substantially the same length and width of the body to reduce the mounting area of the components.

On the other hand, in the case of such a square coil component, there is a problem in that it is difficult to externally specify in which direction the lead portion is being led out because the length and width of the component are substantially the same.

Accordingly, there is increasing demand for square coil components that may be manufactured without specifying the direction in which the lead portion is exposed. In addition, there is a need to improve heat dissipation characteristics in a miniaturized square coil component by expanding a heat dissipation path.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component that may be easily manufactured without specifying a direction in which a lead portion is exposed.

An aspect of the present disclosure is to provide a coil component having improved heat dissipation properties.

According to an aspect of the present disclosure, a coil component includes a support substrate, a coil portion disposed on one surface of the support substrate and having one end and the other end connected by a plurality of turns, a body in which the support substrate and the coil portion are embedded, a lead portion extending from one end of the coil portion, and an auxiliary lead portion disposed between one end of the coil portion and the other end of the coil portion, and extending from the coil portion to be spaced apart from the lead portion, on one surface of the support substrate. The lead portion and the auxiliary lead portion are exposed to an external surface of the body to be spaced apart from each other.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1:
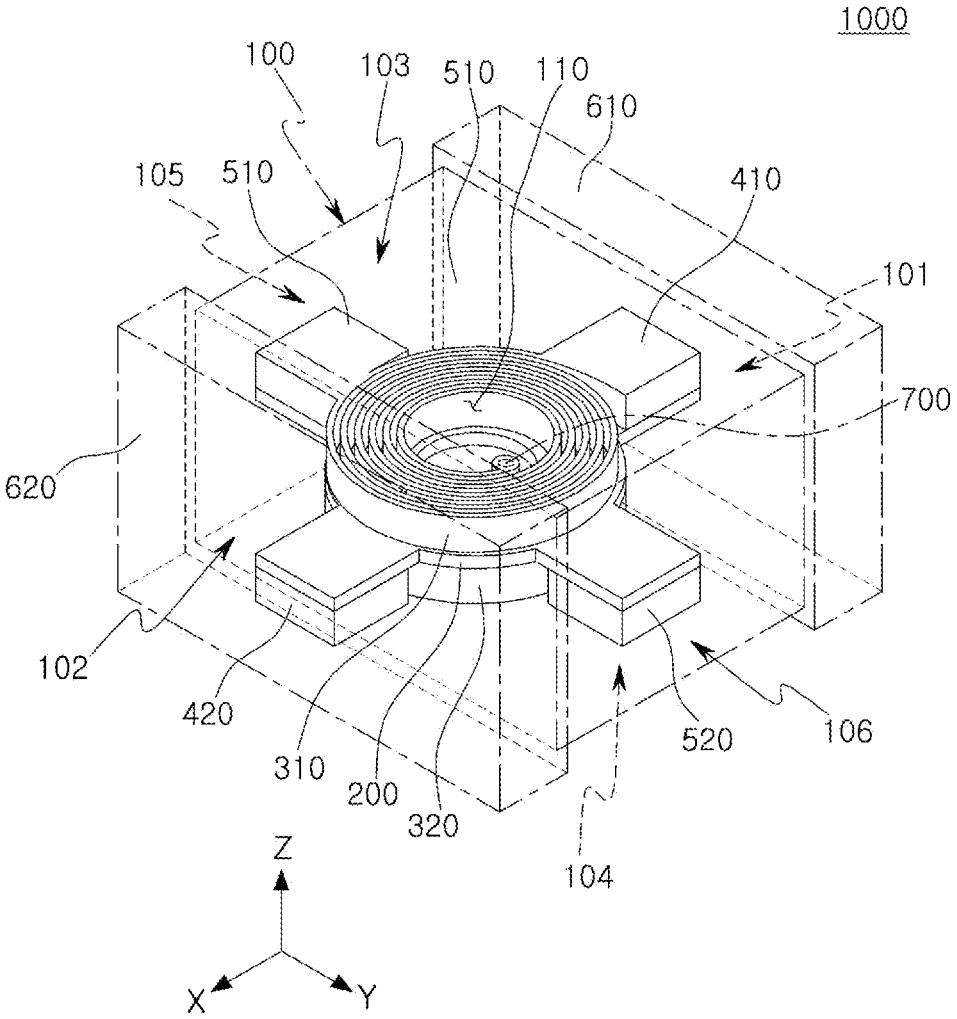
FIG. 1 is a side perspective view schematically illustrating a coil component according to a first embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after gaining an understanding of the disclosure of this application. Further, although the examples described herein have a variety of configurations, other configurations are possible as will be apparent after gaining an understanding of the disclosure of this application.

The drawings may not be to scale, and the relative size, proportions, and depiction of elements in the drawings may be exaggerated for clarity, illustration, and convenience.

In the drawings, the X direction may be defined as a first direction or a longitudinal direction, a Y direction as a second direction or a width direction, and a Z direction as a third direction or a thickness direction.

Hereinafter, a coil component according to an exemplary embodiment will be described in detail with reference to the accompanying drawings, and in describing with reference to the accompanying drawings, the same or corresponding components are assigned the same reference numbers and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency (HF) inductors, general beads, high-frequency beads (GHz beads), and common mode filters.

First Embodiment

Figure 2:
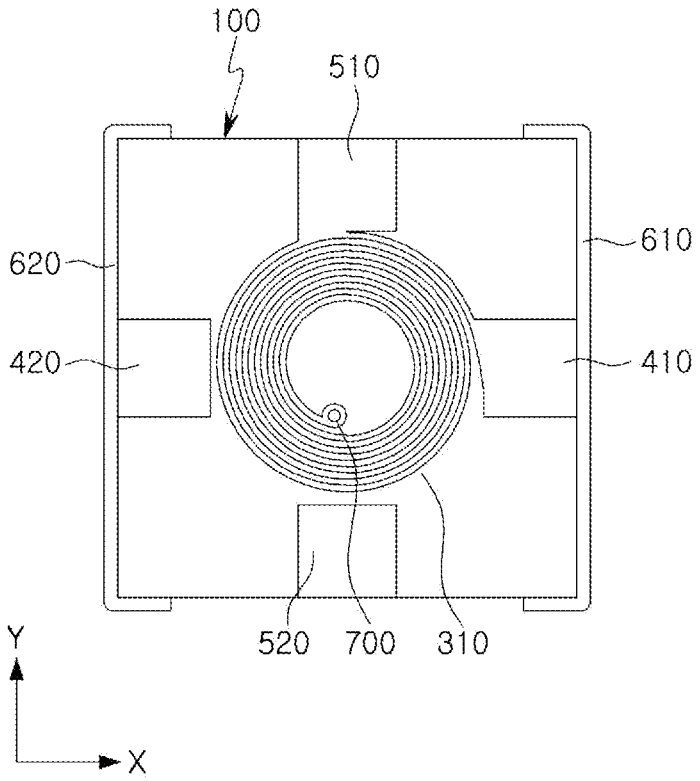
FIG. 2 is a view schematically illustrating a first coil portion, a lead portion, and an auxiliary lead portion of FIG. 1.

FIG. 1 is a perspective view schematically illustrating a coil component according to a first embodiment. FIG. 2 is a view schematically illustrating a first coil portion, a lead portion, and an auxiliary lead portion of FIG. 1.

Referring to FIGS. 1 and 2, a coil component 1000 according to the exemplary embodiment may include a body 100, a support substrate 200, and first and second coil portions 310 and 320. In FIG. 2, for convenience of description, the support substrate 200 is omitted, and the first coil portion 310, lead portions 410 and 420 and auxiliary lead portions 510 and 520 are illustrated.

The support substrate 200 is embedded in the body 100 to be described later. The support substrate 200 includes one surface and the other surface opposing the one surface, and supports the first and second coil portions 310 and 320 to be described later.

The support substrate 200 is formed of an insulating material including a thermosetting insulating resin such as an epoxy resin, a thermoplastic insulating resin such as polyimide, or a photoimageable dielectric resin, or may be formed of an insulating material in which a reinforcing material such as glass fiber or inorganic filler is impregnated in such an insulating resin. As an example, the support substrate 200 may be formed of an insulating material such as prepreg, Ajinomoto Build-up Film (ABF), FR-4, bismaleimide triazine (BT) resin, or Photoimageable Dielectric (PID) film, but the present disclosure is not limited thereto.

As the inorganic filler, at least one or more selected from the group consisting of silica ($SiO_2$), alumina ($Al_2O_3$), silicon carbide (SiC), barium sulfate ($BaSO_4$), talc, mud, mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

When the support substrate 200 is formed of an insulating material including a reinforcing material, the support substrate 200 may provide relatively superior rigidity. When the support substrate 200 is formed of an insulating material that does not contain glass fiber, the support substrate 200 is advantageous in terms of reducing the overall thickness of the first and second coil portions 310 and 320. When the support substrate 200 is formed of an insulating material including a photoimageable dielectric resin, the number of processes of forming the first and second coil portions 310 and 320 may be reduced, which is advantageous in reducing production costs and in forming a fine via.

The body 100 forms the exterior of the coil component 1000 according to this embodiment, and includes the first and second coil portions 310 and 320 embedded therein.

The body 100 may be formed in a hexahedral shape such as, for example, a cube, as a whole.

Based on FIG. 1, the body 100 includes a first surface 101 and a second surface 102 opposing each other in the longitudinal direction X, a third surface 103 and a fourth surface 104 opposing each other in the thickness direction Z, and a fifth surface 105 and a sixth surface 106 opposing each other in the width direction Y. In this embodiment, the first surface 101 and the second surface 102 of the body 100 refer to one side and the other side of the body 100, respectively, the third surface 103 and the fourth surface 104 of the body 100 refer to one surface and the other surface of the body 100, respectively, and the fifth surface 105 and the sixth surface 106 of the body 100 refer to one end surface and the other end surface of the body 100, respectively.

The body 100 may be formed in such a manner that the coil component 1000 according to this embodiment, in which external electrodes 610 and 620 to be described later are formed, has a square shape. The coil component of this embodiment may be configured in such a manner that the length and width of the body 100 are substantially the same as each other, but the embodiment is not limited thereto. As an example, when the length of the body 100 is la and the width of the body 100 is lb, $0.85la \leq lb \leq la$ may be satisfied.

The body 100 includes core portions 110 respectively penetrating through the first and second coil portions 310 and 320 and spaced apart from each other, as described later. The core portions 110 may be formed by filling through-holes of the first and second coil portions 310 and 320 with a magnetic composite sheet, but the embodiment is not limited thereto.

The body 100 may include a magnetic material and a resin. In detail, the body 100 may be formed by laminating one or more magnetic composite sheets including a resin and a magnetic material dispersed in the resin. However, the body 100 may have a structure other than the structure in which the magnetic material is dispersed in the resin. For example, the body 100 may be formed of a magnetic material such as ferrite.

The magnetic material may be ferrite or metal magnetic powder.

The ferrite powder particles may be at least one of, for example, spinel ferrites such as Mg—Zn, Mn—Zn, Mn—Mg, Cu—Zn, Mg—Mn—Sr, Ni—Zn and the like, hexagonal ferrites such as Ba—Zn, Ba—Mg, Ba—Ni, Ba—Co, Ba—Ni—Co and the like, garnet ferrites such as Y, and Li ferrites.

The magnetic metal powder particles may any one or more selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metal powder may be at least one or more of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder and Fe—Cr—Al alloy powder.

The magnetic metal powder may be amorphous or crystalline. For example, the magnetic metal powder may be Fe—Si—B—Cr-based amorphous alloy powder, but is not limited thereto.

The ferrite power and the magnetic metal powder may have an average diameter of about 0.1 μm to 30 μm, respectively, but the diameters thereof are not limited thereto. The term "diameter" as used herein refers to the largest dimension of a given particle. The term "average diameter" as used herein refers to an average of the diameters of particles in a given amount of the magnetic metal powder.

The body 100 may include two or more types of magnetic materials dispersed in a resin. In this case, the fact that the magnetic materials are different types means that the magnetic materials dispersed in the resin are distinguished from each other by any one of an average diameter, a composition, crystallinity, and a shape.

The resin may include an epoxy, polyimide, a liquid crystal polymer, or the like, alone or in combination, but the embodiment is not limited thereto.

The first and second coil portions 310 and 320 are disposed to be spaced apart from each other on one surface and the other surface of the support substrate 200, respectively, to express characteristics of the coil component. As an example, when the coil component 1000 of this embodiment is used as a power inductor, the output voltage may be constantly maintained.

The first and second coil portions 310 and 320 respectively form a plurality of turns about the core portion 110 as an axis. In detail, the first and second coil portions 310 and 320 have one end and the other end connected by a plurality of turns. Referring to FIGS. 1 and 2, respective one ends of the first and second coil portions 310 and 320 are connected to an outermost turn among a plurality of turns, and the other ends of the first and second coil portions 310 and 320 are respectively connected to an innermost turn of the plurality of turns. The first and second coil portions 310 and 320 are connected to each other by a via electrode 700. Referring to FIGS. 1 and 2, the via electrode 700 connects the other end of the first coil portion 310 and the other end of the second coil portion 320 to each other.

The first and second lead portions 410 and 420 extend from one end of the first and second coil portions 310 and 320, respectively, and are exposed to the first surface 101 and the second surface 102 of the body 100, respectively.

The first and second auxiliary lead portions 510 and 520 are disposed between one end and the other end of the first coil portion 310 and one end and the other end of the second coil portions 310 and 320, respectively. In detail, the first and second auxiliary lead portions 510 and 520 extend from the first and second coil portions 310 and 320, respectively, to be spaced apart from the first and second lead portions 410 and 420, on one surface of the support substrate 200. As an example, referring to FIG. 2, the first auxiliary lead portion 510 is disposed between one end portion and the other end portion of the first coil portion 310, and extends from the first coil portion 310 to be spaced apart from the first lead portion 410, on one surface of the support substrate 200. For example, the first and second auxiliary lead portions 510 and 520 are separated from the first and second lead portions 410 and 420 along the turn direction of the outermost turn, and are spaced apart from the first and second lead portions 410 and 420 on the same plane.

Referring to FIGS. 1 and 2, line widths of the first and second lead portions 410 and 420 or the first and second auxiliary lead portions 510 and 520 may be greater than the line width of each of a plurality of turns. Further, although not illustrated in detail, the thicknesses of the first and second lead portions 410 and 420 or the first and second auxiliary lead portions 510 and 520 may be greater than the thickness of each of the plurality of turns.

Referring to FIG. 1, the first auxiliary lead portion 510 is exposed to the fifth surface 105 of the body 100, and the second auxiliary lead portion 520 is exposed to the sixth surface 106 of the body 100.

In the related art coil component, as the first lead portion 410 and the first auxiliary lead portion 510 are disposed on one surface and the other surface of the support substrate 200 to face each other, the first lead portion 410 and the first auxiliary lead portion 510 may be exposed to one side of the body 100, and as the second lead portion 420 and the second auxiliary lead portion 520 are disposed on the other surface and one surface of the support substrate 200 to face each other and, the second lead portion 420 and the second auxiliary lead portion 520 may be exposed to the other side opposing the one side of the body 100.

As described above, in the case in which the first lead portion 410 and the first auxiliary lead portion 510 are exposed to one side of the body 100, and the second lead portion 420 and the second auxiliary lead portion 520 are exposed to the other side of the body 100, the path through which heat is discharged from the inside of the coil component 1000 may be limited to only one side and the other side of the body 100. As a result, the temperature of the core portion and the coil portion surrounding the core portion rises, so that the saturation magnetic flux density may decrease. Therefore, to significantly reduce deterioration of the material, there is a need to further dispose the auxiliary lead portions 510 and 520 that contain a metal component and have a line width greater than a line width of the coil portions 310 and 320. In this embodiment, in detail, by exposing the auxiliary lead portions 510 and 520 to the outer surfaces of the body 100 to which the lead portions 410 and 420 are not exposed, the path through which the heat may be released from the overall component is enlarged.

The first and second coil portions 310 and 320, the first and second lead portions 410 and 420, the first and second auxiliary lead portions 510 and 520, and the via electrode 700 may include at least one or more conductive layers.

For example, when the first and second coil portions 310 and 320, the first and second lead portions 410 and 420, the first and second auxiliary lead portions 510 and 520, and the via electrode 700 are formed by plating on one surface of the support substrate 200, the first and second coil portions 310 and 320, the first and second lead portions 410 and 420, and the first and second auxiliary lead portions 510 and 520, and the via electrode 700 may each include a seed layer such as an electroless plating layer and an electroplating layer.

In this case, the electroplating layer may have a single layer structure or a multilayer structure. The multilayer electroplating layer may be formed of a conformal film structure in which one electroplating layer is covered by the other electroplating layer, or may be formed to have a shape in which the other electroplating layer is laminated only on one surface of one electroplating layer.

The seed layers of the first and second coil portions 310 and 320, the seed layers of the first and second lead portions 410 and 420, the seed layers of the first and second auxiliary lead portions 510 and 520, and the seed layer of the via electrode 700 may be integrally formed, so that a boundary therebetween may not be formed, but the embodiment is not limited thereto. The electroplating layers of the first and second coil portions 310 and 320, the electroplating layers of the first and second lead portions 410 and 420, the electroplating layers of the first and second auxiliary lead portions 510 and 520, and the electroplating layer of the via electrode 700 may be integrally formed, so than a boundary therebetween may not be formed, but the embodiment is not limited thereto.

The first and second coil portions 310 and 320, the first and second lead portions 410 and 420, the first and second auxiliary lead portions 510 and 520, and the via electrode 700 may be respectively formed of a conductive material such as copper (Cu), aluminum (Al), silver (Ag), tin (Sn), gold (Au), nickel (Ni), lead (Pb), titanium (Ti), or alloys thereof, but the embodiment is not limited thereto.

The first and second external electrodes 610 and 620 are disposed outside of the body 100 and disposed on the first surface 101 and the second surface 102 of the body 100 to cover the first and second lead portions 410 and 420, respectively. Referring to FIG. 1, the first and second external electrodes 610 and 620 are connected to the first and second lead portions 410 and 420, respectively, and may not be connected to the first and second auxiliary lead portions 510 and 520. In this case, only the first and second lead portions 410 and 420 connected to the first and second external electrodes 610 and 620 may be used as input and output terminals directly involved in input and output of the current. Therefore, the first and second external electrodes 610 and 620 may not simultaneously cover the first and second lead portions 410 and 420 and the first and second auxiliary lead portions 510 and 520.

In the case of a related art coil component, lead portions connecting a coil portion and an external electrode may be formed on both sides facing each other in the longitudinal direction of a body. Accordingly, in the case of a square coil component having the same length and width of the body, it is difficult to specify on which side an external electrode should be formed because it is not possible to specify on which side the lead portion is led out. On the other hand, in this embodiment of the present disclosure, the first lead portion 410 and the first auxiliary lead portion 510 are disposed on the same plane, while being exposed to the first surface 101 and the fifth surface 105 of the body 100, respectively. In addition, the second lead portion 420 and the second auxiliary lead portion 520 are disposed on the same plane, while being exposed to the second surface 102 and the sixth surface 106 of the body 100, respectively. Accordingly, specifying the surface on which the external electrodes 610 and 620 are to be formed may not be required, and thus, the manufacturing costs and time of the coil component 1000 may be reduced.

The first and second external electrodes 610 and 620 may be formed using a paste containing a metal having excellent electrical conductivity. For example, the paste may be a conductive paste including nickel (Ni), copper (Cu), tin (Sn), silver (Ag) or the like, along or alloys thereof. Further, a plating layer may be further formed on each of the first and second external electrodes 610 and 620. In this case, the plating layer may include any one or more selected from the group consisting of nickel (Ni), copper (Cu), and tin (Sn). For example, a nickel (Ni) layer and a tin (Sn) layer may be formed sequentially.

Modification of First Embodiment

Figure 3:
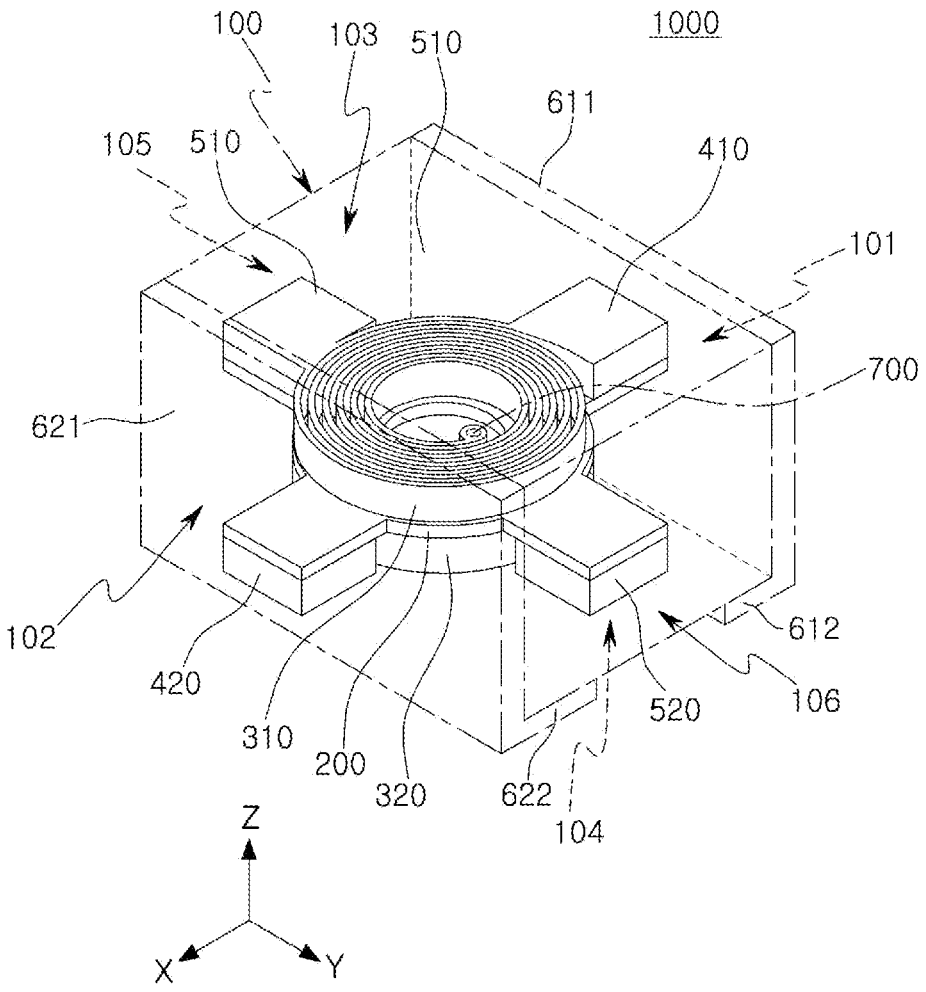
FIG. 3 is a side perspective view schematically illustrating a coil component according to a modification of the first embodiment.
Figure 4:
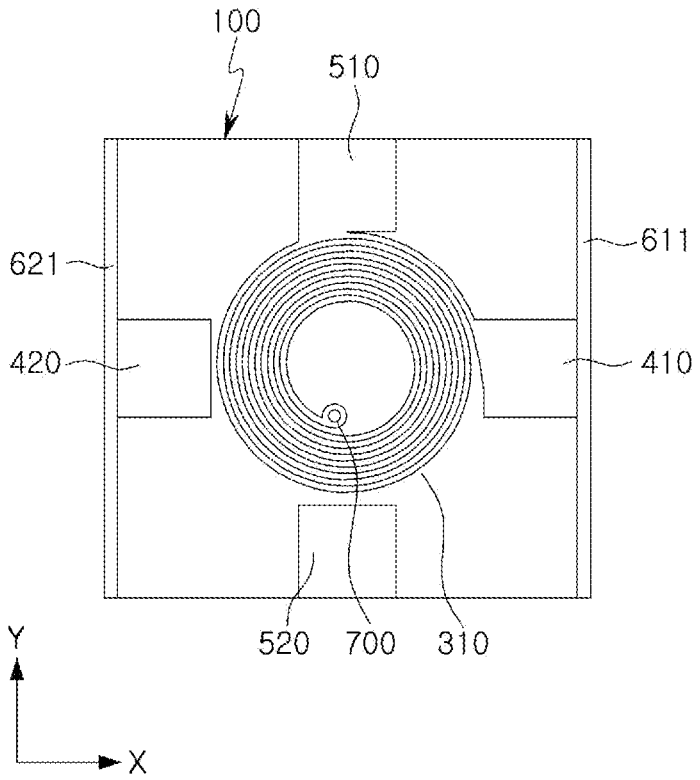
FIG. 4 is a view schematically illustrating a first coil portion, a lead portion, and an auxiliary lead portion of FIG. 3.

FIG. 3 is a side perspective view schematically illustrating a coil component according to a modification of the first embodiment. FIG. 4 is a view schematically illustrating the first coil portion, the lead portion, and the auxiliary lead portion of FIG. 3.

Referring to FIG. 3, in a coil component 1000 according to a modification, the shape of external electrodes 610 and 620 is different from that in the coil component 1000 according to the first embodiment. Therefore, in describing this modification, only the shape of the external electrodes 610 and 620 different from the first embodiment will be described. The rest of the configuration of this modification may be applied as described in the first embodiment.

Referring to FIG. 3, the first and second external electrodes 610 and 620 include first and second connecting portions 611 and 621 connected to the first and second lead portions 410 and 420 and disposed on the first surface 101 and the second surface 102 of the body 100, respectively, and first and second lower surface portions 612 and 622 extending to the fourth surface 104 of the body 100. For example, the first external electrode 610 includes the first connecting portion 611 disposed on the first surface 101 of the body 100 to be connected to the first lead portion 410, and the first lower surface portion 612 extending to the fourth surface 104 of the body 100.

When the coil component 1000 is used as a power inductor, the coil component is mounted on an electronic component package to control the current during power conversion to stabilize the voltage. In this case, since the power inductor occupies a relatively largest mounting space in the electronic component package, it is essential to implement miniaturization of components. However, as the size of the coil component 1000 is miniaturized, performances such as inductance Ls and quality factor Q may be deteriorated. Therefore, there is a need to significantly reduce the size within a range that does not degrade the characteristics of the coil component 1000. Further, as the separation distance between the coil portions 310 and 320 and the external electrodes 610 and 620 is closer, parasitic capacitance between the coil portions 310 and 320 and the external electrodes 610 and 620 may be increased. In this case, there is a problem of reducing the possibility of using the coil component 1000 in a required high frequency band.

In this modification, the external electrodes 610 and 620 are not formed on the third surface 103 of the body 100, which is not provided as a mounting surface on the electronic component package, thereby implementing miniaturization of the entirety of the coil component 1000. In addition, by preventing the external electrodes 610 and 620 from being formed on the third surface 103 of the body 100, parasitic capacitance that may occur between the coil portions 310 and 320 and the external electrodes 610 and 620, may be reduced. As a result, the entire component may be miniaturized without deteriorating the characteristics of the coil component 1000.

Second Embodiment

Figure 5:
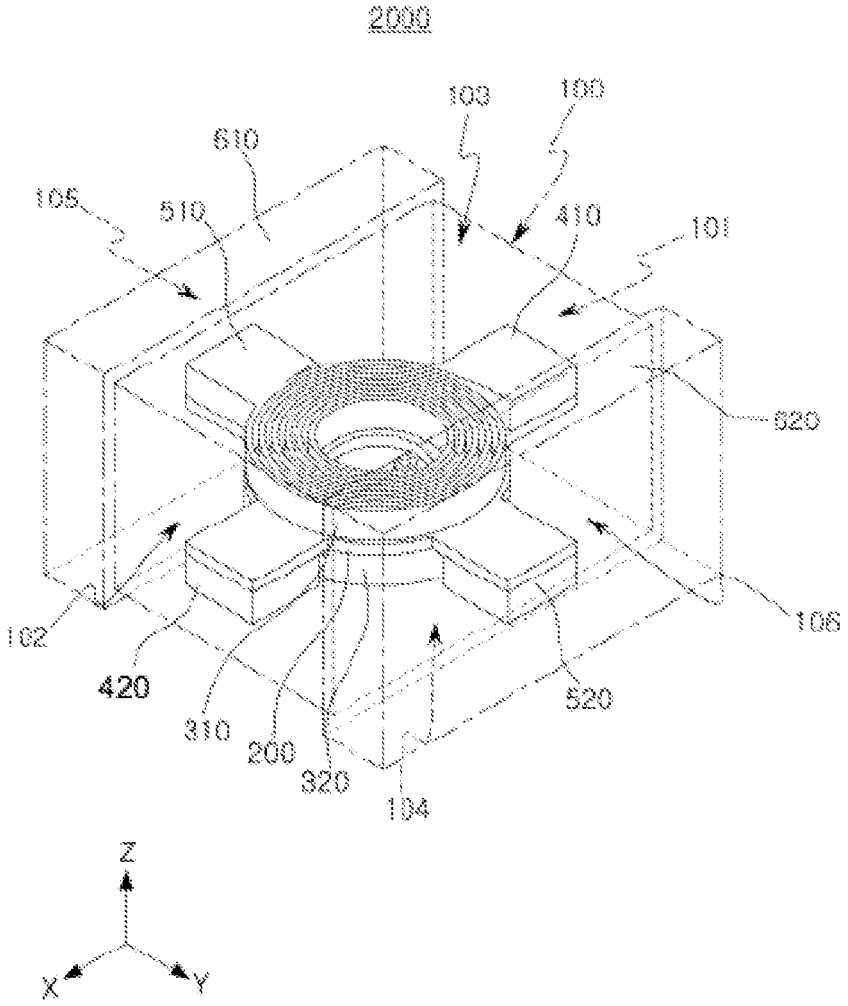
FIG. 5 is a side perspective view schematically illustrating a coil component according to a second embodiment.
Figure 6:
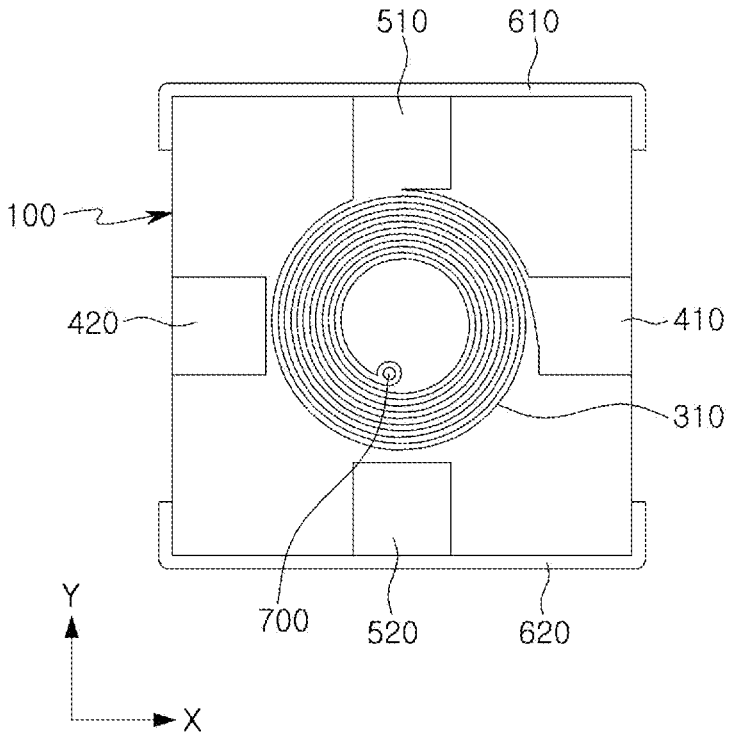
FIG. 6 is a view schematically illustrating a first coil portion, a lead portion, and an auxiliary lead portion of FIG. 5.

FIG. 5 is a side perspective view schematically illustrating a coil component according to a second embodiment. FIG. 6 is a view schematically illustrating a first coil portion, a lead portion, and an auxiliary lead portion of FIG. 5.

Referring to FIG. 5, a coil component 2000 according to the embodiment has a different arrangement structure of the external electrodes 610 and 620 when compared to the coil component 1000 according to the first embodiment. Therefore, in describing this embodiment, only the arrangement structure of the external electrodes 610 and 620 different from the first embodiment will be described. The rest of the configuration of this embodiment may be applied as described in the first embodiment.

Referring to FIG. 5, first and second external electrodes 610 and 620 are disposed on the fifth surface 105 and the sixth surface 106 of the body 100, respectively.

The first and second external electrodes 610 and 620 are respectively provided on the fifth surface 105 and the sixth surface 106 of the body 100 to cover the first and second auxiliary lead portions 510 and 520, respectively.

Referring to FIG. 5, the first and second external electrodes 610 and 620 are connected to the first and second auxiliary lead portions 510 and 520, respectively, and may not be connected to the first and second lead portions 410 and 420. In this case, only the first and second auxiliary lead portions 510 and 520 connected to the first and second external electrodes 610 and 620 may be used as input and output terminals directly involved in input and output of current.

In the case of a related art coil component, the lead portions connecting the coil portion and the external electrode may be formed on both sides of the body opposing each other in the longitudinal direction. Accordingly, in the case of a square coil component having the same length and width of the body, it is difficult to specify on which side an external electrode should be formed because it is not possible to specify on which side the lead portion is led out. On the other hand, in this embodiment, the first lead portion 410 and the first auxiliary lead portion 510 are disposed on the same plane, while being exposed to the first surface 101 and the fifth surface 105 of the body 100, respectively. In addition, the second lead portion 420 and the second auxiliary lead portion 520 are disposed on the same plane, while being exposed to the second surface 102 and the sixth surface 106 of the body 100, respectively. Accordingly, specifying a surface on which the external electrodes 610 and 620 are to be formed may not be required, thereby reducing manufacturing costs and time of the coil component 2000.

Modification of Second Embodiment

Figure 7:
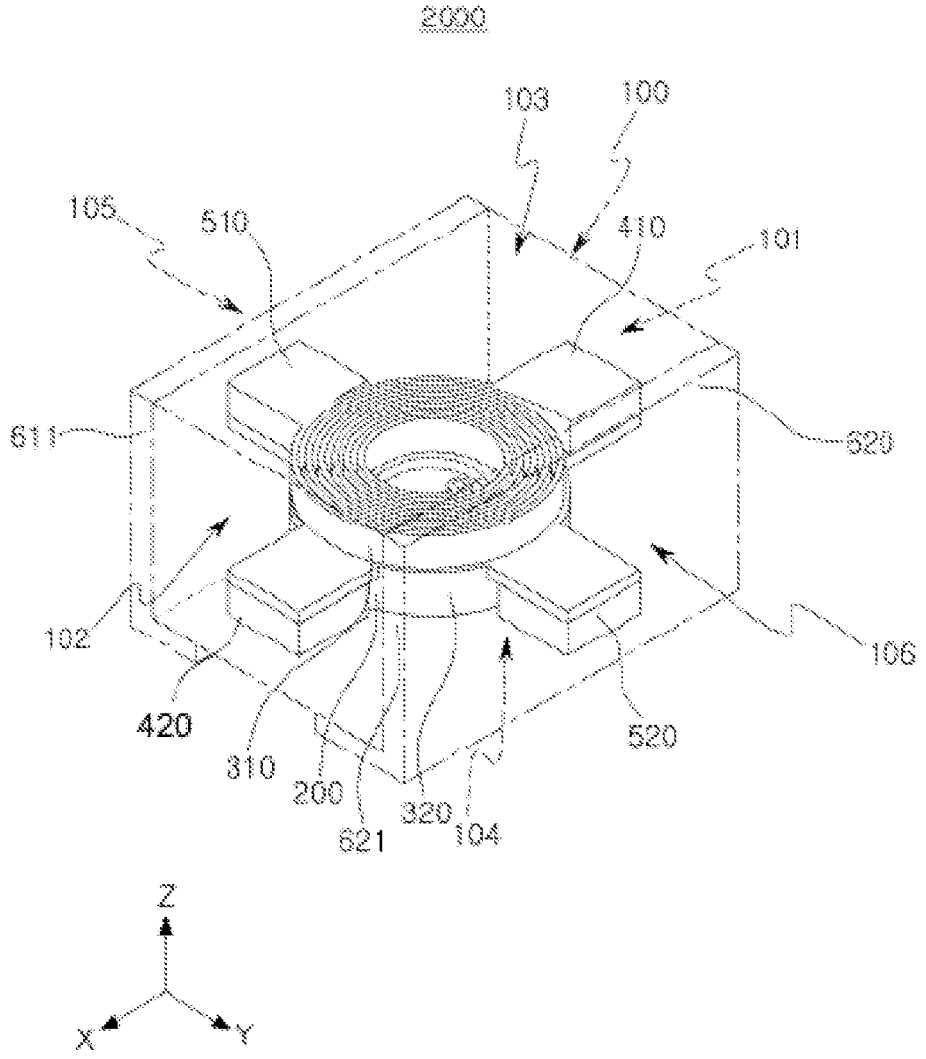
FIG. 7 is a side perspective view schematically illustrating a coil component according to a modification of the second embodiment.
Figure 8:
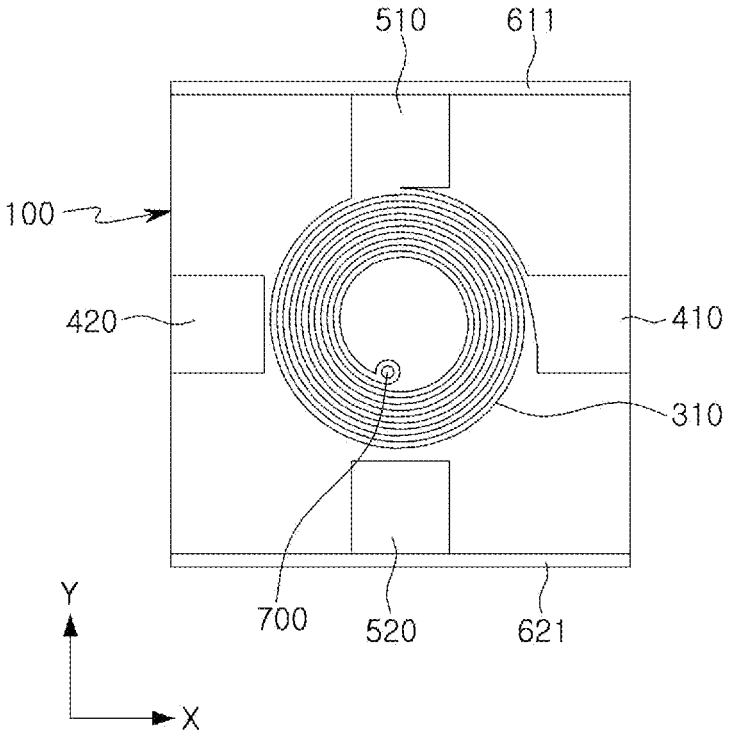
FIG. 8 is a view schematically illustrating a first coil portion, a lead portion, and an auxiliary lead portion of FIG. 7.

FIG. 7 is a side perspective view schematically illustrating a coil component according to a modification of the second embodiment. FIG. 8 is a view schematically illustrating a first coil portion, a lead portion, and an auxiliary lead portion of FIG. 7.

Referring to FIG. 7, in the case of the coil component 2000 according to this modification, the shape of the external electrodes 610 and 620 is different from that of the coil component 2000 according to the second embodiment. Therefore, in describing this modification, only the shape of the external electrodes 610 and 620 different from the second embodiment will be described. The rest of the configuration of this modification may be applied as described in the second embodiment.

Referring to FIG. 7, the first and second external electrodes 610 and 620 include first and second connecting portions 611 and 621 connected to the first and second auxiliary lead portions 510 and 520 and disposed on the fifth surface 105 and the sixth surface 106 of the body 100, respectively, and first and second lower surface portions 612 and 622 extending to the fourth surface 104 of the body 100. For example, the first external electrode 610 includes the first connecting portion 611 disposed on the fifth surface 105 of the body 100 to be connected to the first auxiliary lead portion 510, and the first lower surface portion 612 extending to the fourth surface 104 of the body 100.

When the coil component 2000 is used as a power inductor, the coil component is mounted on an electronic component package to control the current during power conversion to stabilize the voltage. In this case, since the power inductor occupies a relatively largest mounting space in the electronic component package, it is essential to implement miniaturization of components. However, as the size of the coil component 2000 is miniaturized, performances such as inductance Ls and quality factor Q may be deteriorated. Therefore, there is a need to significantly reduce the size within a range that does not degrade the characteristics of the coil component 2000. Further, as the separation distance between the coil portions 310 and 320 and the external electrodes 610 and 620 is closer, parasitic capacitance between the coil portions 310 and 320 and the external electrodes 610 and 620 may be increased. In this case, there is a problem of reducing the possibility of using the coil component 2000 in a required high frequency band.

In this modification, the external electrodes 610 and 620 are not formed on the third surface 103 of the body 100, which is not provided as a mounting surface on the electronic component package, thereby implementing miniaturization of the entirety of the coil component 2000. In addition, by preventing the external electrodes 610 and 620 from being formed on the third surface 103 of the body 100, parasitic capacitance that may occur between the coil portions 310 and 320 and the external electrodes 610 and 620, may be reduced. As a result, the entire component may be miniaturized without deteriorating the characteristics of the coil component 2000.

Third Embodiment

Figure 9:
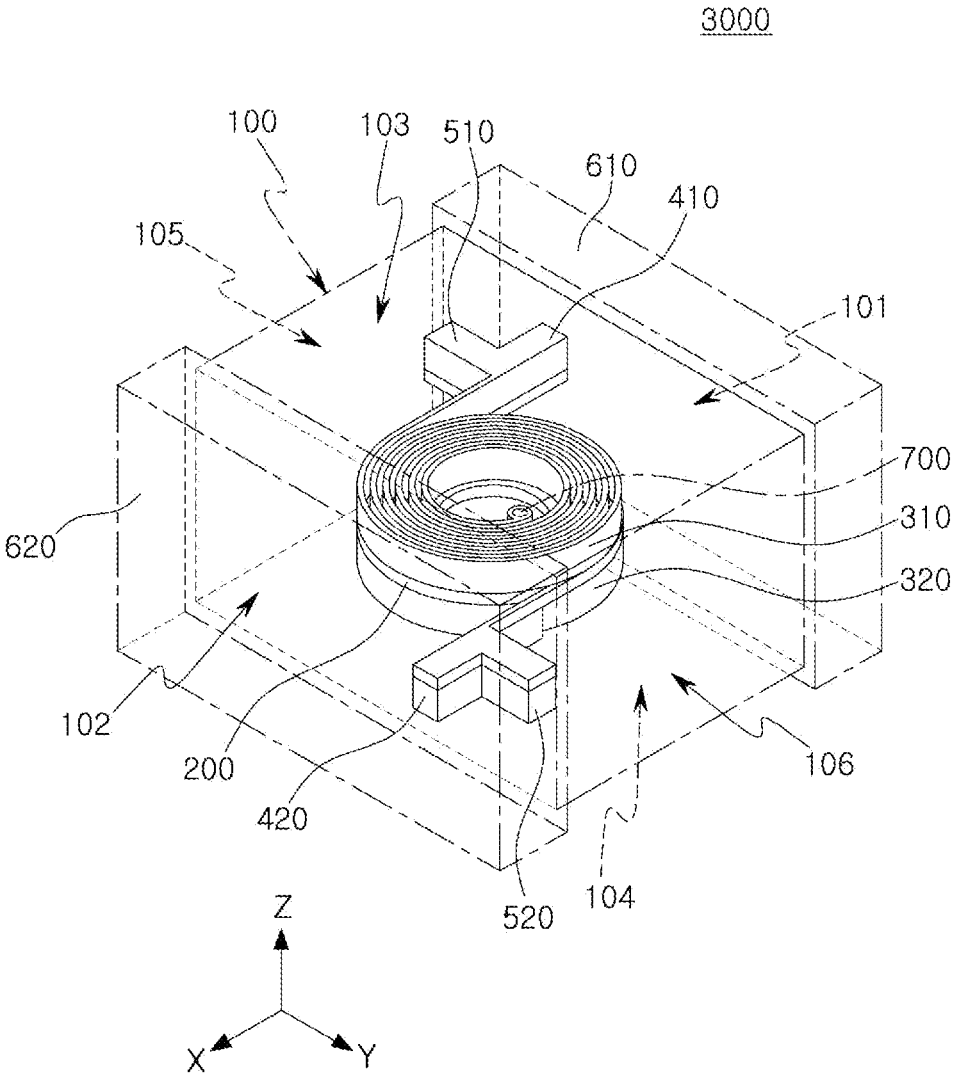
FIG. 9 is a side perspective view schematically illustrating a coil component according to a third embodiment.
Figure 10:
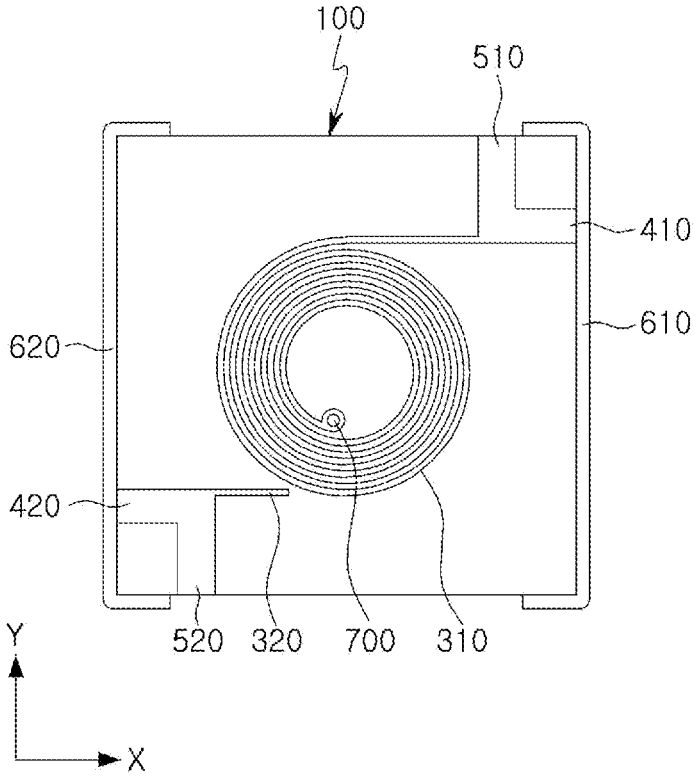
FIG. 10 is a view schematically illustrating a first coil portion, a lead portion, and an auxiliary lead portion of FIG. 9.

FIG. 9 is a side perspective view schematically illustrating a coil component according to a third embodiment. FIG. 10 is a view schematically illustrating a first coil portion, a lead portion, and an auxiliary lead portion of FIG. 9.

Referring to FIG. 9, a coil component 3000 according to the embodiment is compared with the coil component 1000 according to the first embodiment, and is different therefrom in terms of the connection structure of one end of lead portions 410 and 420 and auxiliary lead portions 510 and 520. Therefore, in describing this embodiment, only the connection structures of one end of the lead portions 410 and 420 and the auxiliary lead portions 510 and 520 different from the first embodiment will be described. The rest of the configuration of this embodiment may be applied as described in the first embodiment.

Referring to FIG. 9, one end portion of each of the lead portions 410 and 420 and the auxiliary lead portions 510 and 520 is integrally connected to one end portion of an outermost turn. As an example, referring to FIG. 10, one end of each of the first lead portion 410 and the first auxiliary lead portion 510 is integrally connected to one end of the outermost turn of the first coil portion 310. As a result, the bonding force of one end of the first coil portion 310 with the first surface 101 of the body 100 is increased through the first lead portion 410, and the bonding force thereof with the fifth surface 105 of the body 100 may be increased through the first auxiliary lead portion 510. For example, one end of the first coil portion 310 further increases the bonding force with the body 100 in the width direction Y and the longitudinal direction X of the body 100. As a result, the fixing strength between one end of the coil portion and the body may be improved.

Modification of Third Embodiment

Figure 11:
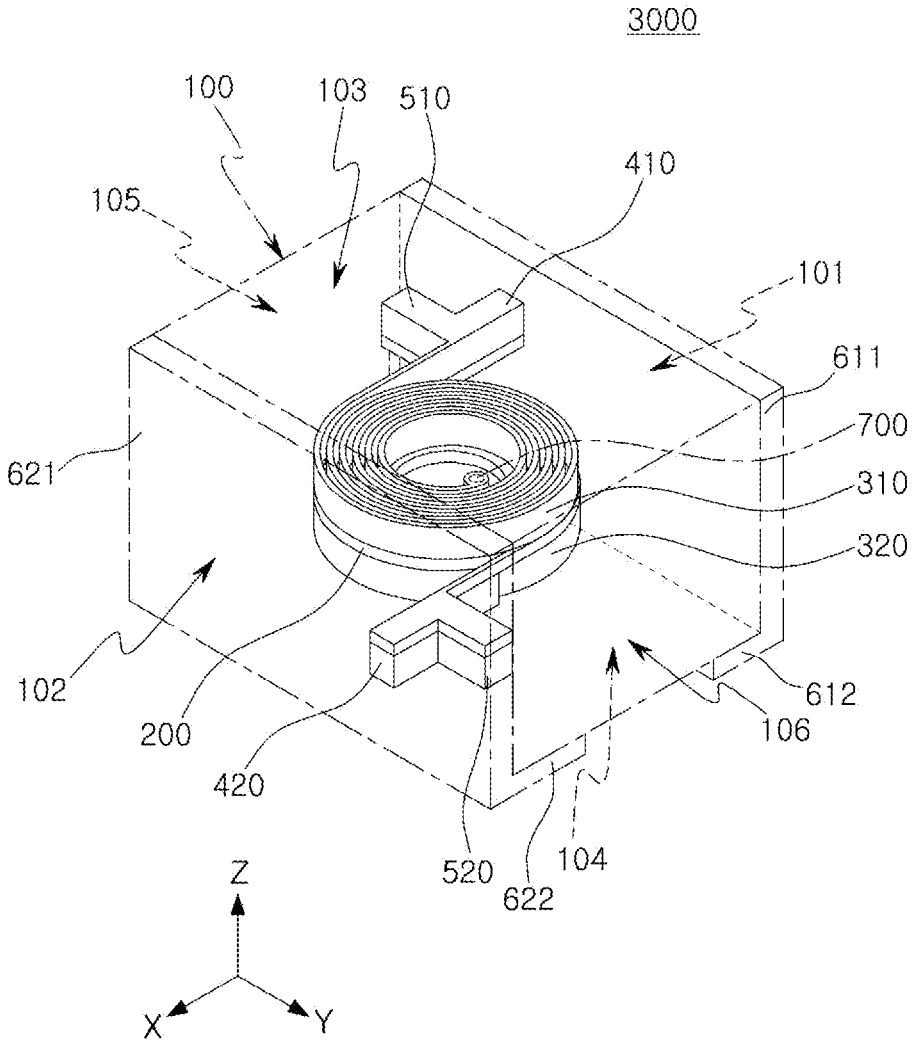
FIG. 11 is a side perspective view schematically illustrating a coil component according to a modification of the third embodiment.
Figure 12:
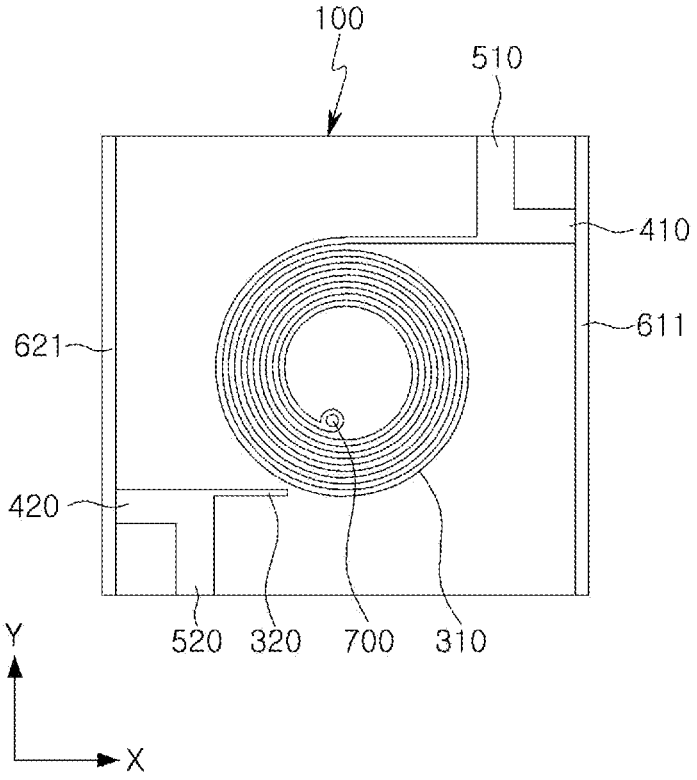
FIG. 12 is a view schematically illustrating a first coil portion, a lead portion, and an auxiliary lead portion of FIG. 11.

FIG. 11 is a side perspective view schematically illustrating a coil component according to a modification of the third embodiment. FIG. 12 is a view schematically illustrating a first coil portion, a lead portion, and an auxiliary lead portion of FIG. 11.

Referring to FIG. 11, in the case of a coil component 3000 according to this modification, the shape of the external electrodes 610 and 620 is different from that of the coil component 3000 according to the third embodiment. Therefore, in describing this modification, only the shape of the external electrodes 610 and 620 different from the third embodiment will be described. The rest of the configuration of this modification may be applied as described in the third embodiment.

Referring to FIG. 11, the first and second external electrodes 610 and 620 include first and second connecting portions 611 and 621 connected to the first and second lead portions 410 and 420 and disposed on the first surface 101 and the second surface 102 of the body 100, respectively, and first and second lower surface portions 612 and 622 extending to the fourth surface 104 of the body 100. For example, the first external electrode 610 includes the first connection portion 611 disposed on the first surface 101 of the body 100 to be connected to the first lead portion 410, and the first lower surface portion 612 extending to the fourth surface 104 of the body 100.

When the coil component 3000 is used as a power inductor, the coil component is mounted on an electronic component package to control the current during power conversion to stabilize the voltage. In this case, since the power inductor occupies a relatively largest mounting space in the electronic component package, it is essential to implement miniaturization of components. However, as the size of the coil component 3000 is miniaturized, performances such as inductance Ls and quality factor Q may be deteriorated. Therefore, there is a need to significantly reduce the size within a range that does not degrade the characteristics of the coil component 3000. Further, as the separation distance between the coil portions 310 and 320 and the external electrodes 610 and 620 is closer, parasitic capacitance between the coil portions 310 and 320 and the external electrodes 610 and 620 may be increased. In this case, there is a problem of reducing the possibility of using the coil component 3000 in a required high frequency band.

In this modification, the external electrodes 610 and 620 are not formed on the third surface 103 of the body 100, which is not provided as a mounting surface on the electronic component package, thereby implementing miniaturization of the entirety of the coil component 3000. In addition, by preventing the external electrodes 610 and 620 from being formed on the third surface 103 of the body 100, parasitic capacitance that may occur between the coil portions 310 and 320 and the external electrodes 610 and 620, may be reduced. As a result, the entirety of component may be miniaturized without deteriorating the characteristics of the coil component 3000.

Fourth Embodiment

Figure 13:
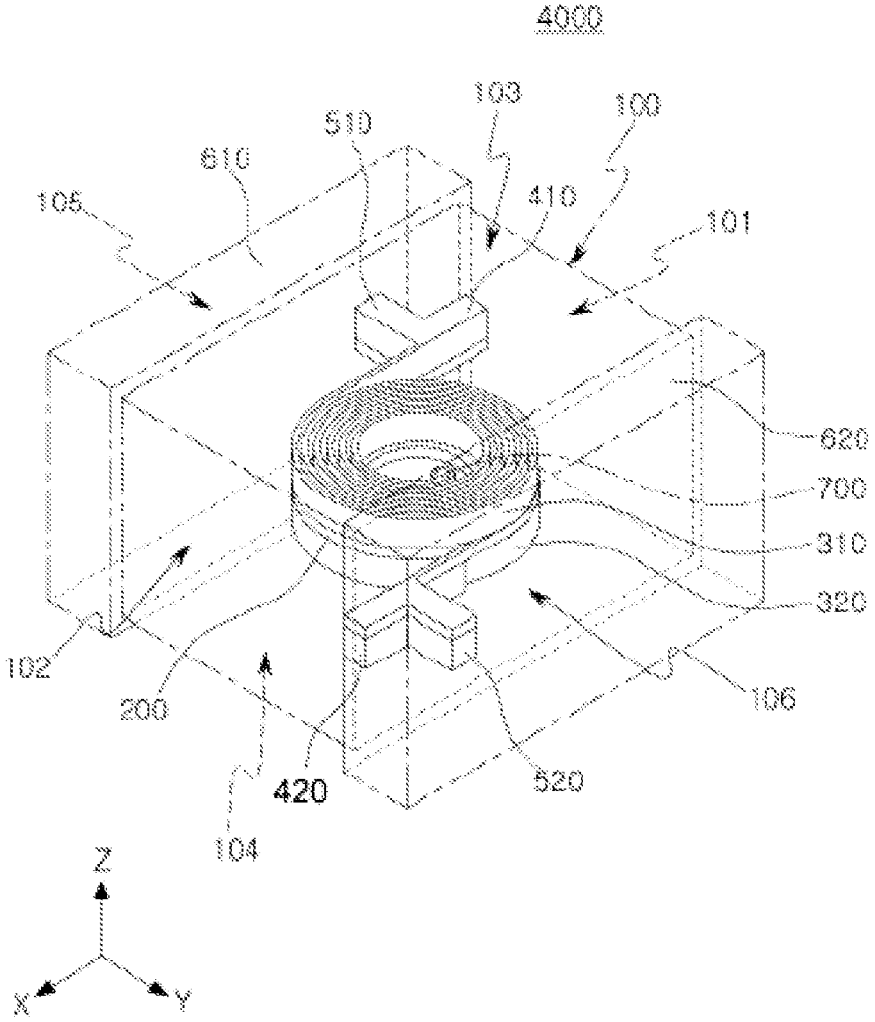
FIG. 13 is a side perspective view schematically illustrating a coil component according to a fourth embodiment.
Figure 14:
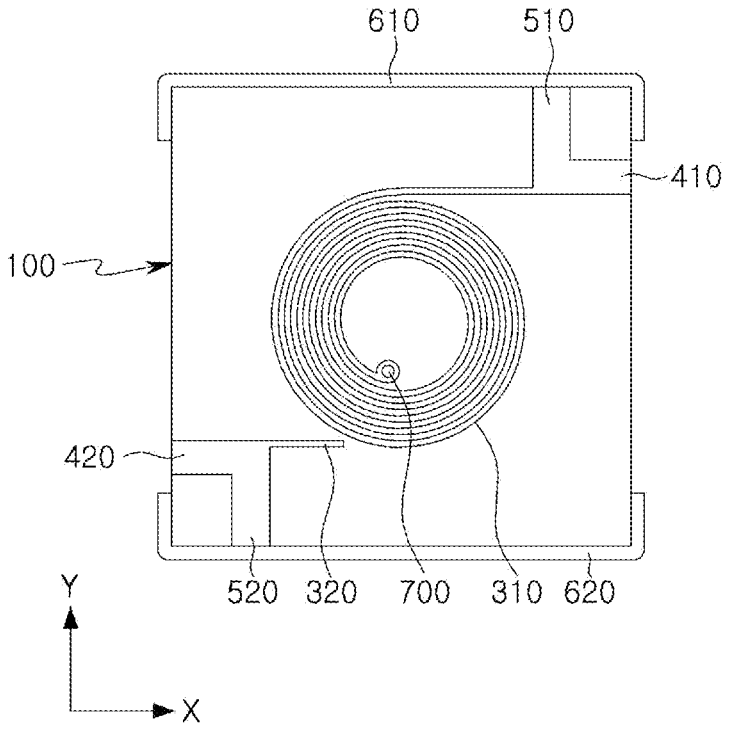
FIG. 14 is a view schematically illustrating a first coil portion, a lead portion, and an auxiliary lead portion of FIG. 13.

FIG. 13 is a side perspective view schematically illustrating a coil component according to a fourth embodiment. FIG. 14 is a view schematically illustrating a first coil portion, a lead portion, and an auxiliary lead portion of FIG. 13.

Referring to FIG. 13, in the case of a coil component 4000 according to the embodiment, the arrangement structure of the external electrodes 610 and 620 is different, compared to the coil component 3000 according to the third embodiment. Therefore, in describing this embodiment, only the arrangement structure of the external electrodes 610 and 620 different from the third embodiment will be described. The rest of the configuration of this embodiment may be applied as described in the third embodiment.

Referring to FIG. 13, the first and second external electrodes 610 and 620 are disposed on the fifth surface 105 and the sixth surface 106 of the body 100, respectively.

The first and second external electrodes 610 and 620 may be connected to the first and second auxiliary lead portions 510 and 520, respectively, to cover the first and second auxiliary lead portions 510 and 520, respectively. Referring to FIG. 13, the first and second external electrodes 610 and 620 are connected to the first and second auxiliary lead portions 510 and 520, respectively, and may not be connected to the first and second lead portions 410 and 420. In this case, only the first and second auxiliary lead portions 510 and 520 connected to the first and second external electrodes 610 and 620 may be used as input and output terminals directly involved in input and output of current.

In the case of a related art coil component, the lead portions connecting the coil portion and the external electrode may be formed on both sides of the body facing each other in the longitudinal direction. Accordingly, in the case of a square coil component having the same length and width of the body, it is difficult to specify on which side an external electrode should be formed because it is not possible to specify on which side the lead portion is led out. On the other hand, in this embodiment, the first lead portion 410 and the first auxiliary lead portion 510 are disposed on the same plane, while being exposed to the first surface 101 and the fifth surface 105 of the body 100, respectively. In addition, the second lead portion 420 and the second auxiliary lead portion 520 are disposed on the same plane, while being exposed to the second surface 102 and the sixth surface 106 of the body 100, respectively. Accordingly, it is not necessary to specify the surface on which the external electrodes 610 and 620 are to be formed, thereby reducing the manufacturing costs and time of the coil component 4000.

Modification of Fourth Embodiment

Figure 15:
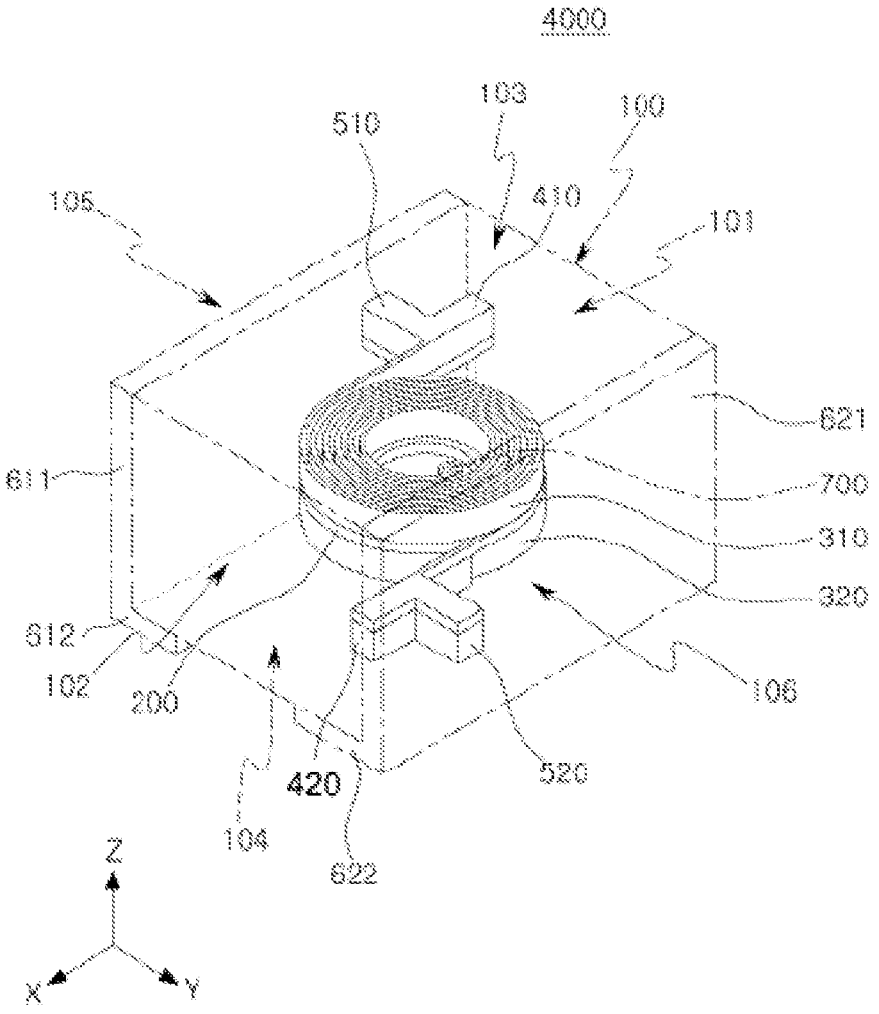
FIG. 15 is a side perspective view schematically illustrating a coil component according to a modification of the fourth embodiment.
Figure 16:
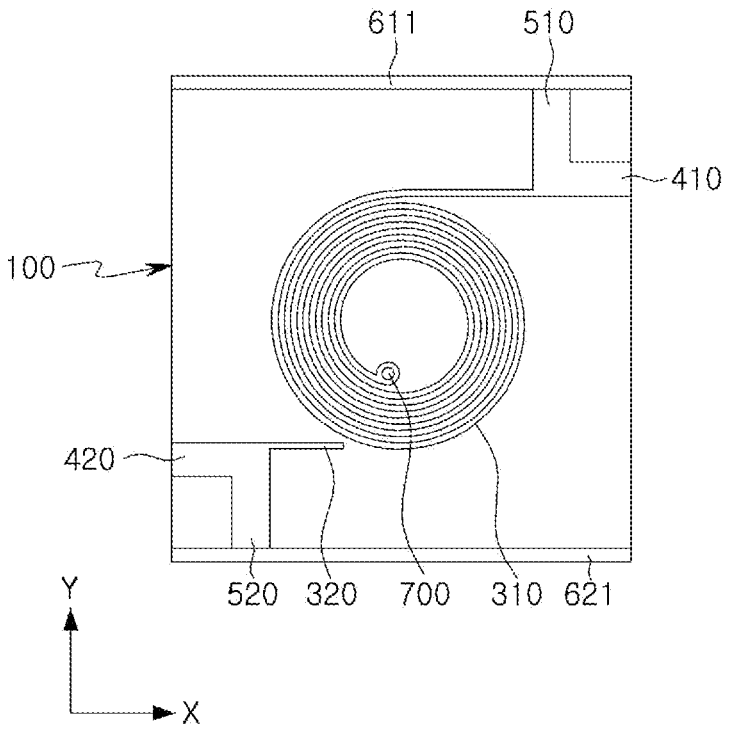
FIG. 16 is a view schematically illustrating a first coil portion, a lead portion, and an auxiliary lead portion of FIG. 15.

FIG. 15 is a side perspective view schematically illustrating a coil component according to a modification of the fourth embodiment. FIG. 16 is a view schematically illustrating a first coil portion, a lead portion, and an auxiliary lead portion of FIG. 15.

Referring to FIG. 15, a coil component 4000 according to the modification has a different shape of the external electrodes 610 and 620 compared to the coil component 4000 according to the fourth embodiment. Therefore, in describing this modification, only the shape of the external electrodes 610 and 620 different from the fourth embodiment will be described. The rest of the configuration of this modification may be applied as described in the fourth embodiment.

Referring to FIG. 15, the first and second external electrodes 610 and 620 include first and second connecting portions 611 and 621 connected to the first and second lead portions 410 and 420 and disposed on the fifth and fifth surfaces 105 and 106 of the body 100, respectively, and first and second lower surface portions 612 and 622 extending to the fourth surface 104 of the body 100. For example, the first external electrode 610 includes the first connecting portion 611 disposed on the fifth surface 105 of the body 100 to be connected to the first lead portion 410, and the first lower surface portion 612 extending to the fourth surface 104 of the body 100.

When the coil component 4000 is used as a power inductor, the coil component is mounted on an electronic component package to control the current during power conversion to stabilize the voltage. In this case, since the power inductor occupies a relatively largest mounting space in the electronic component package, it is essential to implement miniaturization of components. However, as the size of the coil component 4000 is miniaturized, performances such as inductance Ls and quality factor Q may be deteriorated. Therefore, there is a need to significantly reduce the size within a range that does not degrade the characteristics of the coil component 4000. Further, as the separation distance between the coil portions 310 and 320 and the external electrodes 610 and 620 is closer, parasitic capacitance between the coil portions 310 and 320 and the external electrodes 610 and 620 may be increased. In this case, there is a problem of reducing the possibility of using the coil component 4000 in a required high frequency band.

In this modification, the external electrodes 610 and 620 are not formed on the third surface 103 of the body 100, which is not provided as amounting surface on the electronic component package, thereby implementing miniaturization of the entirety of the coil component 4000. In addition, by preventing the external electrodes 610 and 620 from being formed on the third surface 103 of the body 100, parasitic capacitance that may occur between the coil portions 310 and 320 and the external electrodes 610 and 620, may be reduced. As a result, the entirety of component may be miniaturized without deteriorating the characteristics of the coil component 4000.

As set forth above, according to an exemplary embodiment, a square coil component may be easily manufactured without specifying the direction in which the lead portion is exposed.

Further, according to an exemplary embodiment, heat dissipation characteristics may be improved.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a support substrate having a first surface and a second surface opposing the first surface;

first and second coil portions disposed respectively on the first surface and the second surface of the support substrate, and each having a first end and a second end connected by a plurality of turns, the first and second coil portions having a first line width;

a body in which the support substrate and the coil portion are embedded;

a first lead portion having a second line width disposed on the first surface of the support substrate and extending from the first end of the first coil portion;

a first auxiliary lead portion having the second line width disposed between the first end and the second end of the first coil portion, and extending from the first coil portion to be spaced apart from the first lead portion, on the first surface of the support substrate, the first lead portion and the first auxiliary portion being connected to a same turn among the plurality of turns;

a second lead portion having the second line width disposed on the second surface of the support substrate and extending from a first end of the second coil portion; and a second auxiliary lead portion having the second line width disposed between the first end and a second end of the second coil portion, and extending from the second coil portion to be spaced apart from the second lead portion, the second lead portion and the second auxiliary portion being connected to a same turn among the plurality of turns, wherein a section connecting the first and second ends of the first and second coil portions respectively to the first and second lead portions and the first and second auxiliary lead portions has a line width greater than the first line width and smaller than the second line width, and the first and second lead portions and the first and second auxiliary lead portions are exposed to an external surface of the body to be spaced apart from each other.

2. The coil component of claim 1, wherein the body comprises one surface and another surface opposing the one surface, one side and another side connecting the one surface and the other surface and opposing each other, and one end surface and another end surface connecting the one side and the other side and opposing each other, the first and second lead portions are exposed to one side or the other side of the body, and the first and second auxiliary lead portions are exposed to one end surface or the other end surface of the body.

3. The coil component of claim 1, wherein the first end of the first and second coil portions are connected to an outermost turn of the plurality of turns of a corresponding coil portion, and the second end of the first and second coil portions are connected to an innermost turn of the plurality of turns of the corresponding coil portion.

4. The coil component of claim 3, wherein the first and second auxiliary lead portions are disposed to be spaced apart from the first and second lead portions respectively in a turn direction of the outermost turn.

5. The coil component of claim 3, wherein respective first ends of the first and second lead portions and the first and second auxiliary lead portions are integrally connected to a first end of the outermost turn.

6. The coil component of claim 1, wherein the first and second lead portions and the first and second auxiliary lead portions are spaced apart from each other on a same plane.

7. The coil component of claim 1, wherein when a length of the body is la and a width of the body is lb, $0.85la \leq lb \leq la$ is satisfied.

8. The coil component of claim 2, further comprising external electrodes disposed on the one side and the other side of the body, respectively, to cover the first and second lead portions.

9. The coil component of claim 2, further comprising external electrodes disposed on the one end surface and the other end surface of the body, respectively, to cover the first and second auxiliary lead portions.

10. The coil component of claim 9, wherein the external electrodes do not cover the first and second lead portions and the first and second auxiliary lead portions simultaneously.

11. The coil component of claim 1, wherein a line width of the first and second lead portions or the first and second auxiliary lead portions is greater than a line width of each of the plurality of turns.

12. The coil component of claim 1, further comprising a via electrode connecting the first and second coil portions to each other, wherein the via electrode is connected to the second ends of the first and second coil portions.

13. A coil component comprising:

a first coil portion having a plurality of turns disposed between a first end and a second end thereof, the first coil portion being disposed on a first surface of a support substrate;

a second coil portion having a plurality of turns disposed between a first end and a second end thereof, the first coil portion being disposed on a second surface of the support substrate;

a body enclosing the first coil portion, the second coil portion and the support substrate;

a first lead portion extending from the first end of the first coil portion and being exposed to a first external surface of the body;

a first auxiliary lead portion disposed between the first and second ends of the first coil portion and spaced apart from the first lead portion, the first auxiliary portion extending from the first coil portion and being exposed to a second external surface of the body, the first lead portion and the first auxiliary portion being connected to a same turn among the plurality of turns;

a second lead portion extending from the first end of the second coil portion and being exposed to a third external surface of the body; and a second auxiliary lead portion disposed between the first and second ends of the second coil portion and spaced apart from the second lead portion, the second auxiliary portion extending from the second coil portion and being exposed to a fourth external surface of the body, the second lead portion and the second auxiliary portion being connected to a same turn among the plurality of turns, wherein the first and second coil portions have a first line width, and the first lead portion, the second lead portion, the first auxiliary lead portion and the second auxiliary lead portion have a second line width, wherein a section connecting the first and second ends of the first and second coil portions respectively to the first and second lead portions and the first and second auxiliary lead portions has a line width greater than the first line width and smaller than the second line width.

14. The coil component of claim 13, wherein the first lead portion and the first auxiliary lead portion extend from an outermost of the plurality of the turns.

15. The coil component of claim 13, further comprising a first external electrode disposed on one of the first or the second external surfaces of the body.

16. The coil component of claim 13, wherein the second lead portion and the second auxiliary lead portion extend from an outermost of the plurality of the turns of the second coil portion.

17. The coil component of claim 13, further comprising a second external electrode disposed on one of the third or the fourth external surfaces of the body.

18. The coil component of claim 13, wherein the second ends of the first and the second coil portions are connected by a via penetrating the support substrate.

* * * * *